US006917144B2

(12) United States Patent
Batista et al.

(10) Patent No.: US 6,917,144 B2
(45) Date of Patent: Jul. 12, 2005

(54) MICROCHANNEL PLATE HAVING INPUT/ OUTPUT FACE FUNNELING

(75) Inventors: Carlos J. Batista, Gilbert, AZ (US); Michael J. Iosue, Phoenix, AZ (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 10/064,787

(22) Filed: Aug. 16, 2002

(65) Prior Publication Data

US 2004/0032193 A1 Feb. 19, 2004

(51) Int. Cl.[7] ..... H01J 40/06

(52) U.S. Cl. ..... 313/105 CM; 313/103 CM; 313/104; 65/429; 65/411; 65/409

(58) Field of Search ..... 445/24, 49, 50; 313/105 CM, 105 R, 104, 103 CM, 103 R; 65/429, 411, 409, 410

(56) References Cited

U.S. PATENT DOCUMENTS 4,737,013 A * 4/1988 Wilcox ..... 385/120
5,493,169 A 2/1996 Pierle et al. ..... 313/103 CM
5,565,729 A * 10/1996 Faris et al. ..... 313/103 CM
6,215,232 B1 4/2001 Johnson et al. ..... 313/103 CM
6,311,001 B1 10/2001 Rosine ..... 385/120

* cited by examiner

*Primary Examiner*—Edward J. Glick
*Assistant Examiner*—Elizabeth Keaney
(74) *Attorney, Agent, or Firm*—Marsteller & Associates, P.C.

(57) ABSTRACT

A microchannel plate (P) for receiving photoelectrons includes a plate-like substrate web (W) formed from a plurality of micro-tubules (10) of a single type of cladding glass (12) and defining a pair of opposite faces (14*a* and 14*b*). The substrate web (W) further includes a plurality of microchannel passages (16) extending between the opposite faces (14*a* and 14*b*) and having openings (18*a* and 18*b*, respectively) in both of the opposite faces (14*a* and 14*b*). The microchannel openings (18) have funnel-like entries or openings (20) formed in the substrate web (W) with at least one of the opposite faces (14).

7 Claims, 3 Drawing Sheets

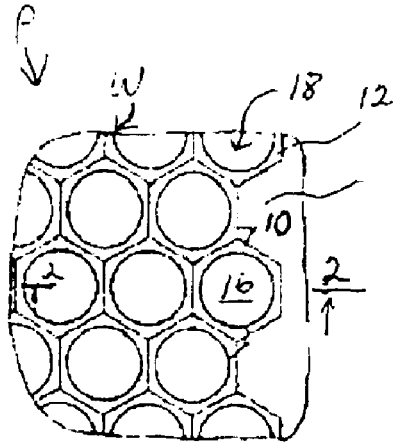
Fig 1
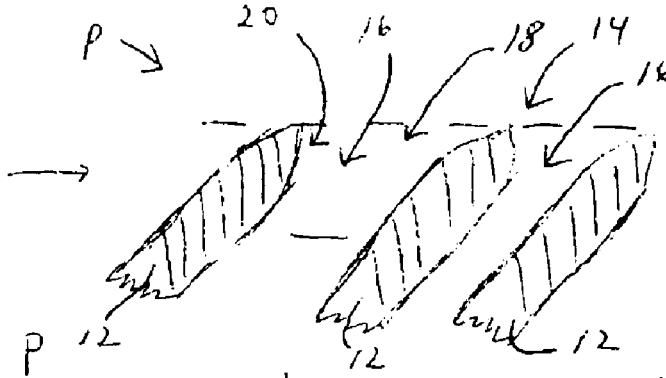
Fig 2
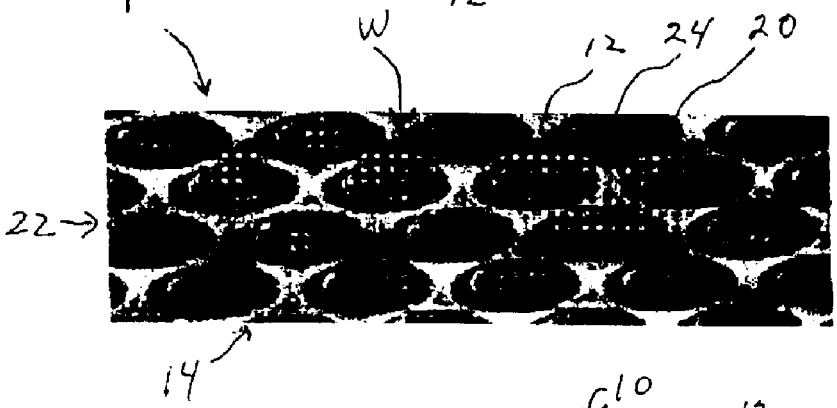
Fig 3
Fig 3a
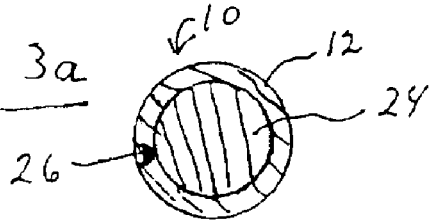

MICROCHANNEL PLATE HAVING INPUT/ OUTPUT FACE FUNNELING

BACKGROUND OF INVENTION

The invention relates to the field of electro-optical devices and more particularly to microchannel plates (MCPs) and methods for manufacture.

A night vision system converts available low intensity ambient light to a visible image. These systems require some residual light, such as moon or star light as an example, in which to operate. This light is generally rich in infrared radiation, which is invisible to the human eye. The ambient light is intensified by the night vision device to produce an output image which is visible to the human eye. The image intensification process involves conversion of the received ambient light into electronic patterns and the subsequent projection of the electron patterns onto a receptor to produce an image visible to the eye. Typically, the receptor is a phosphor screen which is viewed through a lens provided as an eyepiece.

Specific examples of microchannel plate amplification are found in the image intensifier tubes of the night vision devices commonly used by police departments and by the military for night time surveillance, and for weapon aiming. However, microchannel plates may also be used to produce an intensified electrical signal indicative of the light flux or intensity falling on a photocathode, and even upon particular parts of the photocathode. The resulting electrical signals can be used to drive a video display, for example, or be fed to a computer for processing of the information present in the electrical analog of the image.

In known night vision devices, a photoelectrically responsive photocathode element is used to receive photons from a low light level image. Typically the low light level image is far too dim to view with unaided natural vision, or may only be illuminated by invisible infrared radiation. Radiation at such wavelengths is rich in the nighttime sky. The photocathode produces a pattern of electrons (hereinafter referred to as "photoelectrons") which correspond with the pattern of photons from the low-level image. Through the use of electrostatic fields, the pattern of photoelectrons emitted from the photocathode is directed to the surface of a microchannel plate.

The pattern of photoelectrons is then introduced into a multitude of small channels (or microchannels) opening onto the surface of the plate which, by the secondary emission of electrons, produce a shower of electrons in a pattern corresponding to the low-level image. That is, the microchannel plate emits from its microchannels a proportional number of secondary emission electrons. These secondary emission electrons form an electron shower thereby amplifying the electrons produced by the photocathode in response to the initial low level image. The shower of electrons, at an intensity much above that produced by the photocathode, is then directed onto a phosphorescent screen. The phosphor of the screen produces an image in visible light which replicates the low-level image.

More particularly, the microchannel plate itself conventionally is formed from a bundle of very small cylindrical tubes, or micro-tubules, which have been fused together into a parallel orientation. The bundle is then sliced to form the microchannel plate. These small cylindrical tubes of the bundle thus have their length arranged generally along the thickness of the microchannel plate. That is, the thickness of the bundle slice or plate is not very great in comparison to its size or lateral extent; however, the microchannels individually are very small so that their length along the thickness of the microchannel plate is still many times their diameter. Thus, a microchannel plate has the appearance of a thin plate with parallel opposite surfaces.

The plate may contain millions of microscopic tubes or channels communicating between the faces of the microchannel plate. Each tube forms a passageway or channel opening at its opposite ends on the opposite faces of the plate. Further, each tube is slightly angulated with respect to a perpendicular from the parallel opposite faces of the plate so that electrons approaching the plate perpendicularly can not simply pass through one of the many microchannels without interacting with the interior surfaces.

Rather than directing the electron shower from a microchannel plate to a phosphorescent screen to produce a visible image, the shower of electrons may be directed upon an anode in order to produce an electrical signal indicative of the light or other radiation flux incident on the photocathode. The electrical analog signal may be employed to produce a mosaic image by electrical manipulation for display on a cathode ray screen, for example. Still alternatively, such a microchannel plate can be used as a "gain block" in a device having a free-space flow of electrons. That is, the microchannel plate provides a spatial output pattern of electrons which replicates an input pattern, and at a considerably higher electron density than the input pattern. Such a device is useful as a particle counter to detect high energy particle interactions which produce electrons.

Regardless of the data output format selected, the sensitivity of the image intensifier or other device utilizing a microchannel plate is directly related to the amount of electron amplification or "gain" imparted by the microchannel plate. That is, as each photoelectron enters a microchannel and strikes the wall, secondary electrons are knocked off or emitted from the area where the photoelectron initially impacted. The physical properties of the walls of the microchannel are such that, generally, a plurality of electrons is emitted each time these walls are contacted by one energetic electron. In other words, the material of the walls has a high coefficient of secondary electron emission or, put yet another way, the electron-emissivity of the walls is greater than one.

Propelled by the electrostatic field across the microchannel plate, the secondary electrons travel toward the far surface of the microchannel plate away from the photocathode and point of entry. Along the way, each of the secondary electrons repeatedly interact with the walls of the microchannel plate resulting in the emission of additional electrons. Statistically, some of the electrons are absorbed into the material of the microchannel plate so that the photoelectrons do not generally escape the plate. However, the secondary electrons continue to increase or cascade along the length of the microchannels. These electrons in turn promote the release of yet additional electrons farther along the microchannel tube. The number of electrons emitted thus increases geometrically along the length of the microchannel to provide a cascade of electrons arising from each one of the original photoelectrons which entered the tube. As discussed above, this electron cascade then exits the individual passageways of the microchannel plate and, under the influence of another electrostatic field, is accelerated toward a corresponding location on a display electrode or phosphor screen. The number of electrons emitted from the microchannel, when averaged with those emitted from the other microchannels, is equivalent to the theoretical amplification or gain of the microchannel plate.

While the intensity of the original image may be amplified several times, various factors can interfere with the efficiency of the process thereby lowering the sensitivity of the device. For example, one inherent problem of microchannel plates is that a photoelectron released from the photocathode may not fall into one of the slightly angulated microchannels, but impacts the bluff conductive face of the plate in a region between the openings of the microchannel tubes. Such bounced photoelectrons, which then produce a number of secondary electrons from a part of the microchannel plate not aligned with the proper location of photocathode generation, decrease the signal-to-noise ratio, visually distorting the image produced by the image intensifier. Other times the errant electron is simply absorbed by a metallized conductive face of the plate and is not amplified to produce part of the image or signal produced by the detector anode.

Of course, one solution to this problem is to increase the amount of microchannel aperture area on the input face of the microchannel plate as was done in U.S. Pat. No. 4,737,013, issued 12 Apr. 1988, to Richard E. Wilcox. Through the use of an etching barrier around each microchannel, these particular microchannel plates have an improved ratio of total end open area of the microchannels to the area of the plate. Specifically, the etching barrier incorporated in the plate allows more precise etching of the microchannel tubes in the plate. The technique allows the plates to be produced with a theoretical open area ratio (OAR) of up to 90% of the plate active surface. As a result, the photoelectrons are not as likely to miss one of the microchannels and impact on the face of the microchannel plate to be bounced into another one of the microchannels. This higher OAR improves the signal-to-noise ratio of image intensification.

A second method to increase the OAR was disclosed in U.S. Pat. No. 5,493,169, issued 20 Feb. 1996, and related division patent U.S. Pat. No. 5,776,538, issued 7 Jul. 1998, to Robert L. Pierle, et al. Pierle taught forming a microchannel plate from first and second cladding glasses and a core glass and then three different etching process steps. Funnel-like openings at each end of the microchannels were disclosed. Multiple etching steps and at least three types of glasses are required to etch away the selected glass portions to form the microchannels. The first cladding glass was used to prevent "the acid from etching completely through the walls of [the] microchannels." (col. 15, lines 61–63 of U.S. Pat. No. 5,493,169)

While the above cited references introduce and disclose a number of noteworthy advances and technological improvements within the art, none completely fulfills the specific objectives achieved by this invention.

SUMMARY OF INVENTION

In accordance with the present invention, a microchannel plate for receiving photoelectrons includes a plate-like substrate web formed from a plurality of micro-tubules of a single type of cladding glass and defining a pair of opposite faces. The substrate web further includes a plurality of microchannel passages extending between the opposite faces and having openings in both of the opposite faces. The microchannel openings have funnel-like openings formed in the substrate web with at least one of the opposite faces.

Accordingly, it is an object of the present invention to provide an improved microchannel plate having both increased electron-emission gain and an improved signal-to-noise ratio.

These and other objects, advantages and features of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

FIG. 1 is a plan view of a portion of a microchannel plate of the present invention.

FIG. 2 is a partial cross sectional view taken along line 2—2 of FIG. 1.

FIG. 3 is an isomeric view of a partially etched microchannel plate before the core glass is fully etched away.

FIG. 3*a* is a cross section of a single micro-tubule having both the core and cladding glasses.

DETAILED DESCRIPTION

Figure 4:
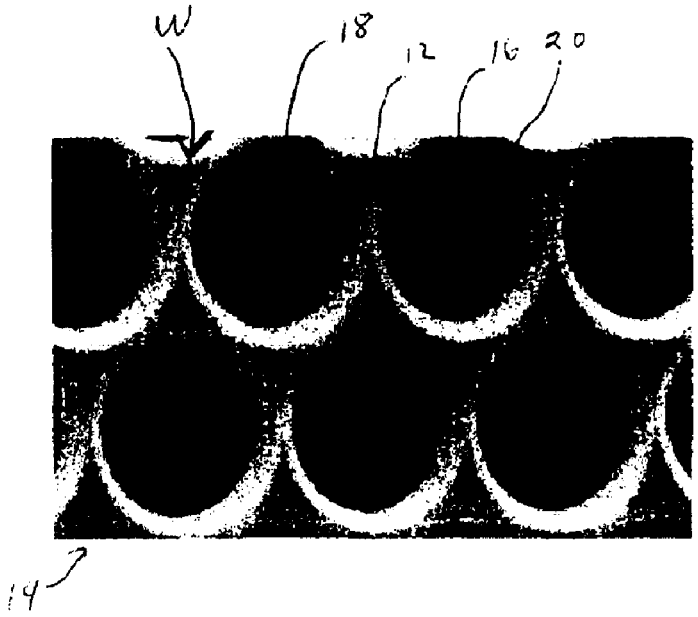
FIG. 4 is an isomeric view of the microchannels of the present invention.
Figure 5:
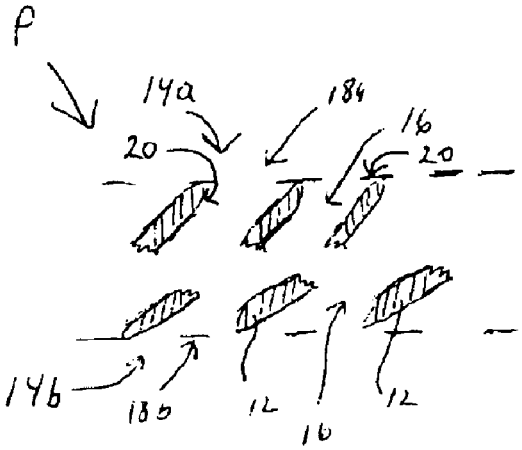
FIG. 5 is another cross-section taken along line 2—2 of FIG. 1 showing the funneling of both opposite faces of the microchannel plate.
Figure 6:
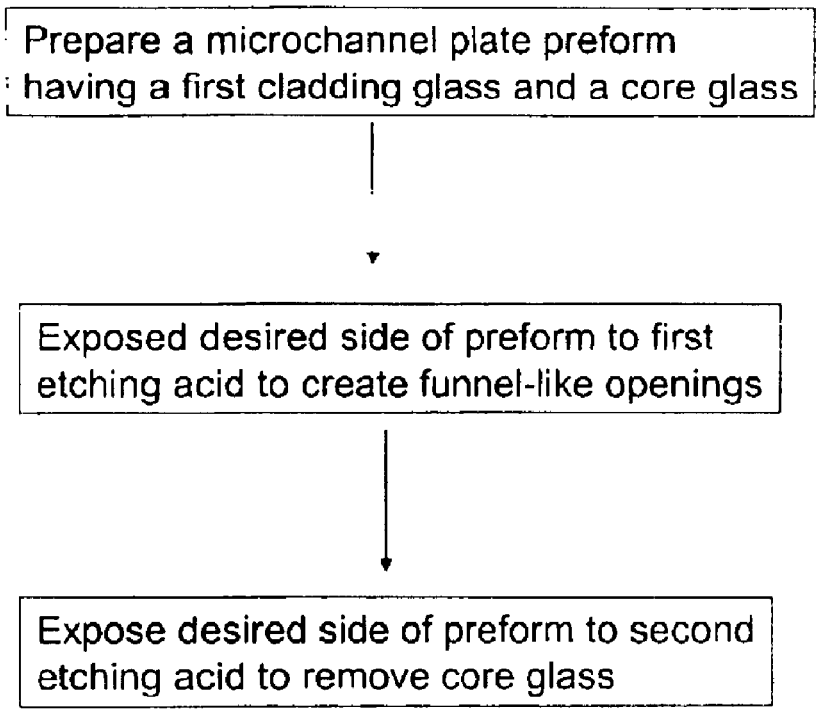
FIG. 6 is a flowchart for manufacturing the present microchannel plate having funnel-like openings.

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

A microchannel plate (P) for receiving photoelectrons includes a plate-like substrate web (W) formed from a plurality of micro-tubules (10) of a single type of cladding glass (12) and defining a pair of opposite faces (14*a* and 14*b*). The substrate web (W) further includes a plurality of microchannel passages (16) extending between the opposite faces (14*a* and 14*b*) and having openings (18*a* and 18*b*, respectively) in both of the opposite faces (14*a* and 14*b*). The microchannel openings (18) have funnel-like entries or openings (20) formed in the substrate web (W) with at least one of the opposite faces (14).

In the manufacturing process for the MCP (P) of the present invention, the microchannel plate preform (22) having two opposite faces (14) including a core glass (24) and a first cladding glass (12) is first etched for a desired period of time. The first etching tends to create funnel-like openings (20) at the intersection of the core (24) and first cladding glass (12). The first etching can be done at one or both of the opposite faces (14), as desired. The microchannel preform (22) having been first etched (see FIG. 3) is then subjected to a second etching process to fully remove the remaining core glass (24) and thereby forming the plate-like substrate web (W).

The different chemical properties of the first cladding (12) and core (24) glasses permit the glasses to be selectively and discretely removed from the MCP (P) in the preform state (22) in which a multitude of micro-tubules (10) of cladding glass (12) surrounding a core glass rod (24) are fused together. Such a process is described in U.S. Pat. Nos. 4,737,013 and 5,776,538, which are incorporated by reference herein.

In the present invention, only two types of glasses are used to form the operable microchannel plate web (W), a core (24) and a clad (12). The funnel-like openings (20) are actually formed by etching the core and clad glasses (24 and 12, respectively) in the preform state (22) with a suitable, known acid, such as hydrofluoric acid. The first acid attacks the surface (26) where both glasses meet at the walls (26). (See FIGS. 3 and 3*a*) The core (24) serves as a mask to protect the depth of the channel.

The core glass (24) is subsequently fully etched away with a second etching acid, such as hydrochloric. Removal of the core glass (24) exposes the microchannels (16) forming the web (W).

A true funnel shaped entrance (20) is optionally created at both sides (14) of the MCP (P), leaving less 3000 angstroms of wall separation between adjacent channels (16), by way of example. Channel diameter and funnel depth can be measured with high accuracy using the present technique.

The Open Area Ratio (OAR) can be controlled by regulating the length of time the preform (22) is exposed to the first etching acid (etch time), thereby having control over funnel opening size and depth.

The present method of creating the funnel-like openings (20) in the MCP (P) promotes generally higher signal to noise than prior known methods. A noise factor bellow 1.8 can be achieved. Further, improved Modulation Transfer Function (MTF) may also result.

The ability to mask one side (14) of the MCP (P) with a resist, such as an acrylic, or any other masking material that can be easily removed, can be used to allow etching on a single side only, the input side for instance, or both sides can be etched at the same time as desired.

The foregoing disclosure and description of the invention are illustrative and explanatory thereof, and various changes in the size, shape and materials, as well as in the details of the illustrated construction may be made without departing from the spirit of the invention.

What is claimed is:

1. A microchannel plate for receiving photoelectrons comprising:

a plate-like substrate web formed from a plurality of microtubules of a single type of acid soluble cladding glass and defining a pair of opposite faces;

the substrate web including a plurality of microchannel passages extending between the opposite faces and having openings in both of the opposite faces;

the microchannel openings having a funnel-like opening formed in the substrate web at least one of the opposite faces; and the microchannel plate is formed from a microchannel plate preform including a core glass different from the cladding glass; the microchannel plate preform is first etched for a desired period of time with a first acid selected to create the funnel-like openings at the intersection of the core and cladding glass at least one of the opposite faces; the microchannel preform having been first etched is then subjected to a second etching process with a second selected acid to remove the remaining core glass forming the plate-like substrate web.

2. The invention of claim 1 wherein the first acid is hydrofluoric acid.

3. The invention of claim 1 wherein the second acid is hydrochloric acid.

4. A method for manufacturing a microchannel plate including the steps of:

etching a microchannel plate preform having two opposite faces including a core glass and a single type of acid soluble cladding glass different from the core glass with a first acid selected for a desired period of time to create funnel-like openings at the intersection of the core and cladding glass at one or both of the opposite faces;

subjecting the microchannel preform having been first etched to a second etching process with a second selected acid to remove the remaining core glass forming the plate-like substrate web.

5. The method of claim 4 wherein the first acid is hydrofluoric acid.

6. The method of claim 4 wherein the second acid is hydrochloric acid.

7. A microchannel plate preform comprising:

a plate-like substrate formed from a plurality of adjacent microtubules of a single type of acid soluble cladding glass and defining a pair of opposite faces; and the microtubules being formed having an interior acid soluble core glass different from the cladding glass.

* * * * *